United States Patent [19]

Muscaglione et al.

[11] Patent Number: 4,716,266

[45] Date of Patent: Dec. 29, 1987

[54] ELECTRICAL ARC QUENCHING CHAMBER, IN PARTICULAR FOR FLUID-QUENCHED CIRCUIT BREAKERS

[75] Inventors: Giuseppe Muscaglione, Pontirolo Nuovo; Gianpietro Talpo, Bergamo, both of Italy

[73] Assignee: SACE S.p.A. Costruzioni Elettromeccaniche, Milan, Italy

[21] Appl. No.: 918,879

[22] Filed: Oct. 15, 1986

[30] Foreign Application Priority Data

Dec. 3, 1985 [IT] Italy ..... 23074 A/85

[51] Int. Cl.[4] ..... H01H 33/70

[52] U.S. Cl. ..... 200/148 R; 200/148 A; 200/252

[58] Field of Search ..... 200/148 A, 148 R, 252

[56] References Cited

U.S. PATENT DOCUMENTS 4,393,291 7/1983 Stewart et al. ..... 200/148 A
4,427,862 1/1984 Lin ..... 200/252
4,475,018 10/1984 Arimoto et al. ..... 200/148 R
4,514,605 4/1985 Van ..... 200/148 A

*Primary Examiner*—Robert S. Macon
*Attorney, Agent, or Firm*—Diller, Ramik & Wight

[57] ABSTRACT

The present invention relates to an electrical arc interruption chamber, in particular for fluid-quenched circuit breakers, in which, inside a tightly sealed insulating encasing, containing an arc-quenching gas, provided are current-bearing connections, respectively supporting a movable main contact and a stationary main contact, each one of the main contacts being provided with its respective arc contact, and wherein the movable arc contact of the tulip type is positioned inside a wall element of insulating material, having, e.g., the shape of an upside-down bell, the movable contact and the bell-shaped element being housed inside the body of the movable main contact, in order to define a first chamber for the passage of the arc-quenching gas between the said body and the said insulating element, defined being furthermore a second chamber for the passage of the arc-quenching gas, which is movable between the movable arc contact and the bell-shaped element.

20 Claims, 6 Drawing Figures

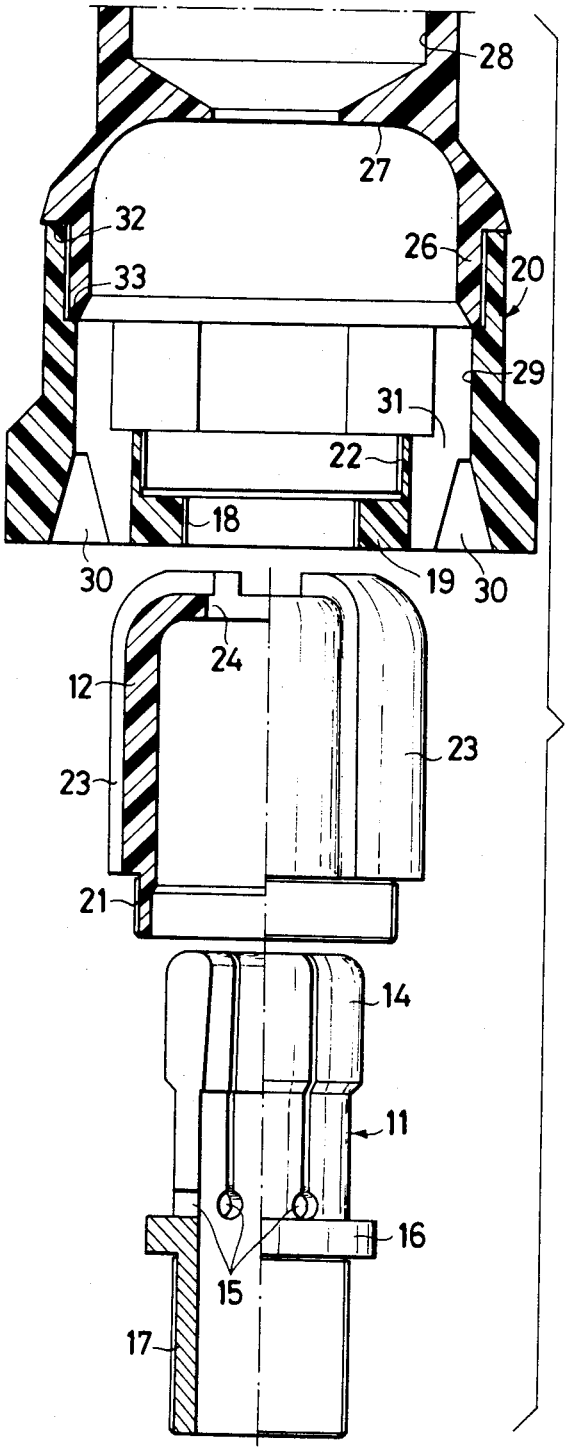
Fig.1
Fig.2
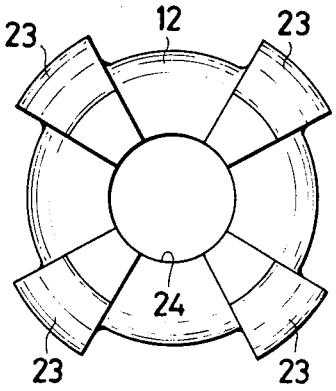

ELECTRICAL ARC QUENCHING CHAMBER, IN PARTICULAR FOR FLUID-QUENCHED CIRCUIT BREAKERS

The present invention relates to an electrical arc interruption chamber, in particular for fluid-quenched circuit breakers.

Interruption chambers for fluid-quenched circuit breakers are known, wherein during the opening of the contacts an electrical arc quenching fluid, generally gaseous, is used.

The energy developed by the electrical arc, while heating the gas, decomposes it, generating a pressure which provides a blast of fluid onto the arc, causing it to be quenched.

According to known solutions, interruption chambers are provided, which are equipped with elements of electrical insulating material, provided with suitably shaped and orientated openings, which allow the gas to circulate under pressure, to accomplish the quenching.

Such types of chambers, due to the difficulty met with in accomplishing the optimum conditions required for the interruption of the currents throughout the range provided by the operations, i.e., from the small overload up to the highest interruption powers, are characterized by a narrow operation range, i.e., if the dimensioning is designed to interrupt high currents, do not result effective in quenching the lower currents, and vice-versa.

Purpose of the present invention is to obviate the disadvantages of the cited prior art, by providing a universal interruption chamber, which, on the basis of its inner geometry, allows the necessary gas pressures and speeds, and hence high interruption powers to be generated without losing efficaciousness when the interruption of the lowest overload currents is required.

In order to achieve such a purpose, the present invention provides an electrical arc interruption chamber, in particular for fluid-quenched circuit breakers, wherein, inside a tightly sealed electrical insulating encasing, containing an arc-quenching gas, provided are current-bearing connections, respectively supporting a movable main contact and a stationary main contact, each one of the said main contacts being provided with its respective arc contact, characterized in that the said movable arc contact of the tulip type is positioned inside an element made of electrical insulating material, having the shape of an upside-down bell, said movable contact and said bell-shaped element being solidly affixed to each other, and being housed inside the body of the said movable main contact, in order to define a first chamber for the passage of the arc-quenching gas between the said body and the said electrical insulating element, defined being furthermore a second chamber for the passage of the said arc-quenching gas between said movable arc contact and said bell-shaped element.

Figure 3:
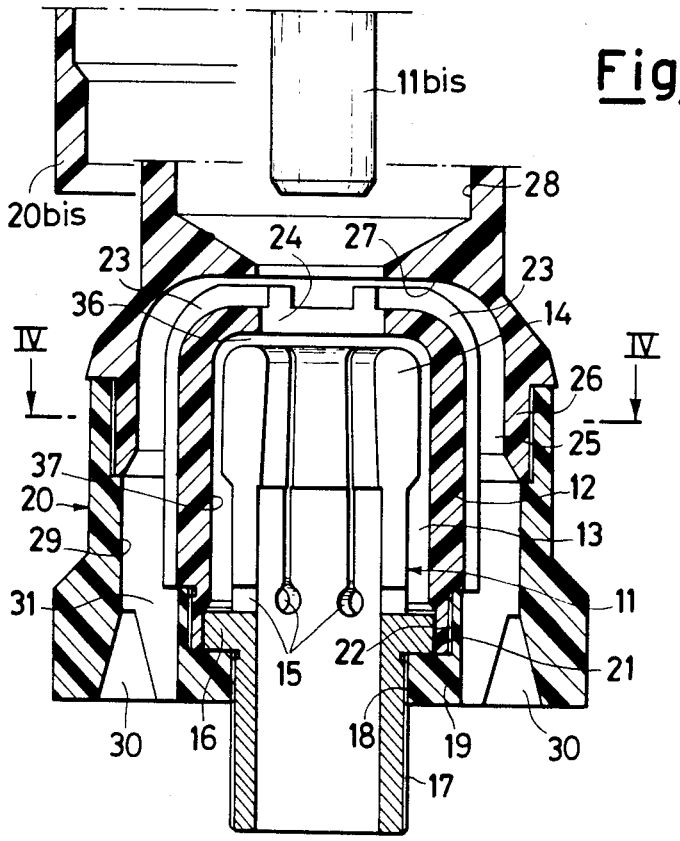
Figure 4:
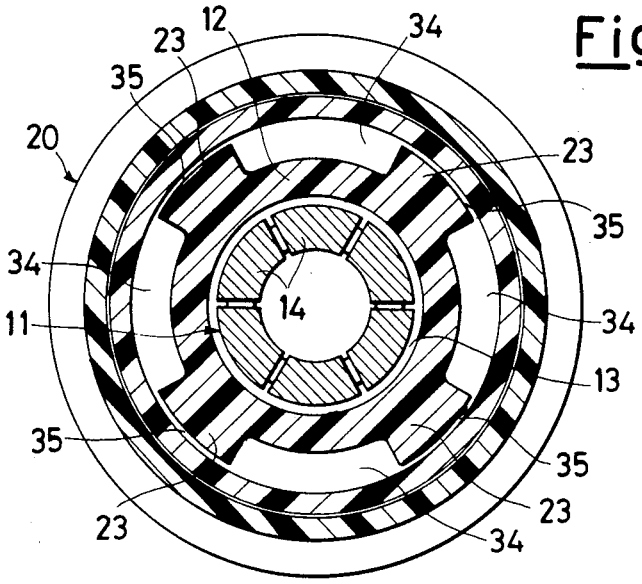
Figure 5:
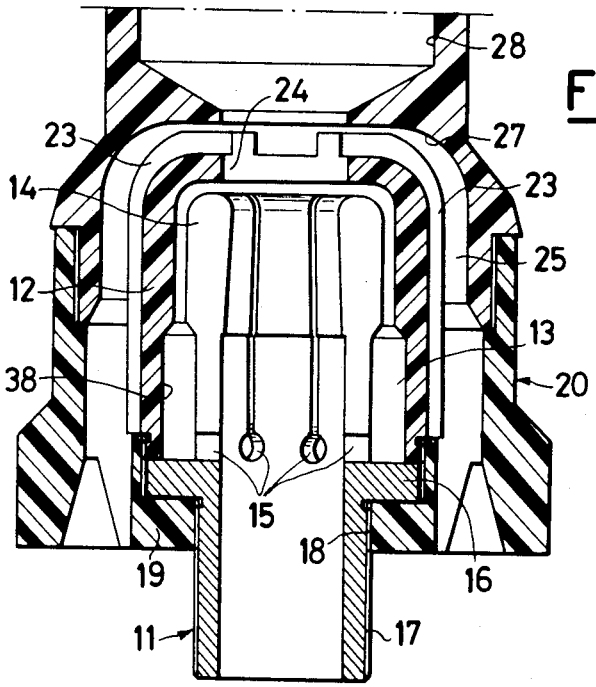
Figure 6:
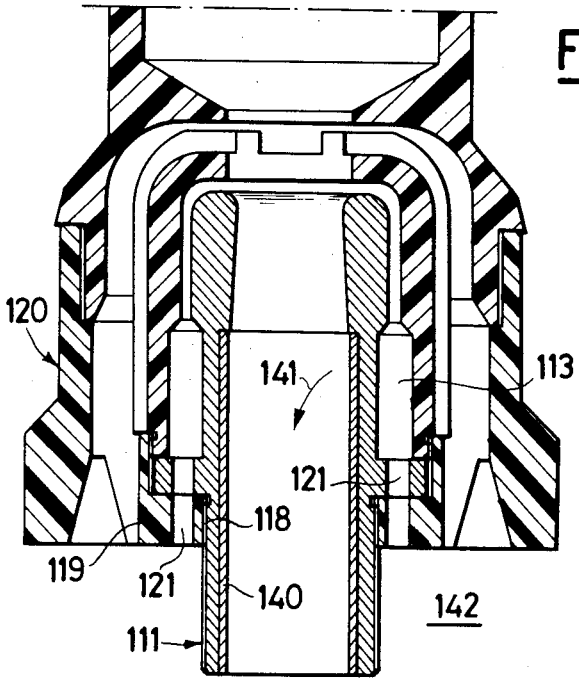

The characteristics and the advantages of the interruption chamber of the present invention shall appear more clearly from the following disclosure, referred to the attached drawings, wherein:

FIG. 1 is a partly sectional exploded view of a first form of practical embodiment of an interruption chamber according to the invention, FIG. 2 is a plan view of the intermediate element of FIG. 1, FIG. 3 is a sectional elevation view of the elements of FIG. 1, in their assembled condition, FIG. 4 is a sectional view along the path IV—IV of FIG. 3, FIG. 5 is a sectional elevation view of a second form of practical embodiment of the interruption chamber according to the invention, and FIG. 6 is a sectional elevation view of a third form of practical embodiment of the interruption chamber according to the present invention.

Inside a tightly sealed electrical insulating encasing, (not shown in the Figures; also other structural parts not strictly relating to the invention have not been shown) and containing an arc-quenching gas, such as sulphur hexafluoride, current-bearing connections are provided, respectively bearing a movable main contact 20 and a stationary main contact **20*b* is, together with the related arc contact 11 (the movable contact) and 11*b*** is (the stationary contact).

Referring to the figures, there is shown a movable arc contact 11 of tubular type with longitudinal notches, or more precisely of the tulip type, positioned inside a bell-shaped element 12 of electrical insulating material, solid with the said movable contact, which surrounds it, and is positioned above the said arc contact 11.

A first chamber 13 is so defined, which is comprised between the movable arc contact 11 and the inner surface 37 of the wall element 12.

The movable arc contact 11 has, as said, an upper portion made of petals 14 radially enlarged upwards, and at the attachment of which radial discharge holes 15 are provided.

An intermediate portion 16 radially enlarged to a ring-shape separates a lower threaded portion 17, suitable to be screwed, down inside a complementary seat 18 centrally provided in a body 19 of a movable main contact 20.

Also from the bell-shaped element 12 a cylindrical threaded portion 21 protrudes downwards, which can be positioned inside a complementary threaded seat 22, concentric to the seat 18, and is, too, provided in the body 19 of the main movable contact 20.

On its outer surface, the bell-shaped element 12 is provided with protruding portions 23, e.g., with four of them, running along generatrices thereof, curved towards a nozzle 24.

Coaxially around said first chamber 13, a second chamber 25 is provided, which is circumferentially bounded on one side by the element 12 and on the other side by a wall of electrical insulating material 26 with crown 27, in which a nozzle-shaped opening 28 is provided, and in its remaining parts by the inner walls 29 of the body 19, a set of four holes 30, positioned on an annular portion 31 of the body, concentric to the said threaded seats 18 and 22, being furthermore provided.

The wall of electrical insulating material 26 and the movable main contact 20 are connected to each other by respective annular, threaded and complementary undercuts 32 and 33 which couple with each other, creating one single outer body.

During the opening of the main contacts 20 and 20bis, between the arc contacts 11 and 11bis, the electrical arc is exactly generated, which, by overheating the surrounding arc-quenching medium causes it to flow, under pressure, inside the coaxial chambers 13 and 25 and inside the movable arc contact 11.

In particular, inside the chamber 25 the gas flows from down upwards, passing into a zone 34 at lower speed and pressure, and into a zone 35, of smaller volume, at higher speed and pressure. In this way, in the area wherein the electrical arc is generated, a more effective and even gas blast action is obtained, which favours a reduction in the arc-quenching times and hence a lower and more uniform wear of the top portion of element 12.

Furthermore, the particular profile of the bell-shaped element 12, and in particular the protruding portions 23 allow the gas pressure increase law in the compression step during the opening of the contacts to be varied, with a consequent reduction in the volume of the pumped gas and an increase in capacity of interruption, with the diameters of the stationary arc contact and of the movable arc contact, and the diameters of components 24–27 and 28 being the same.

As regards then the chamber 13, the suitably shaped discharge holes 15 favour the generation of a vacuum in an upper zone 36 of the movable arc contact 11 wherein the arc is generated. Such a vacuum favours then the removal of heat from the zone 36 wherein the arc is formed, further increasing the interruption power, in that the arc which is generated on contacts opening is cooled more rapidly.

In another form of practical embodiment of the interruption chamber of the invention and shown in FIG. 5, element 12 is internally and in its lowermost portion provided, with a recessed portion 38, which defines, together with the movable contact 11, a volume greater than that defined by the homologous straight portion 37 of FIG. 3.

A further form of practical embodiment of the interruption chamber, always according to the present invention, is shown in FIG. 6, with a movable contact 111 shaped as to have in its interior a portion 140 made of electrical insulating material, which modifies the gas discharge from the zone 113 towards the direction 141. In a similar way to as shown in FIG. 3, the movable arc contact 111 is housed inside a seat 118 centrally provided in a body 119 of a movable main contact 120.

Coaxially with and externally to the seat 118 a suitably dimensioned annular through-hole 121 is provided, which places the chamber 113 in communication towards the bottom 142 with the remainder of the electrical insulating envelope, not shown.

In such a way, the chamber 113 and chamber 142, behave, for certain current values as a function of the diameter of hole 121 and of the volumes of chambers 113 and 142, as a true double collecting chamber for the overheated gas, which flows downwards under its self-generated pressure, because, in this case, it can escape through the annular hole 121, favouring the quenching of the arc by heat removal from the arc zone during the passage of the arc current, and subsequently in the neighbourhood of the zero of said current, it being cooled, by there being mixed with the gas of the chambers 113 and 141, flows into the arc zone, accomplishing the arc quenching by pressure self-generation.

The present invention has been disclosed to illustrative and not limitative purposes according to preferred forms of practical embodiment thereof, with reference to the figures of the hereto attached drawing tables, but it must be understood that modifications and changes can be done by those skilled in the art, without however exiting from the scope of protection of the present patent application.

We claim:

1. An electric arc interruption chamber particularly adapted for use with fluid-quenched circuit breakers having an arc-quenching gas within a sealed electrically insulated casing comprising a movable main contact and a stationary main contact each having a respective arc contact, said movable arc contact being a tulip contact defined by a plurality of spaced fingers, a generally bell-shaped member constructed of electrically insulated material, said bell-shaped member being defined by a peripheral wall and an end wall, said end wall having an opening in alignment with and through which relatively moves said stationary arc contact, an exterior of said fingers and an interior of said bell-shaped member defining a first chamber, said movable main contact having a housing constructed of electrically insulating material; said housing being defined by a peripheral wall and an end wall in external space relationship to said bell-shaped member peripheral wall and end wall, respectively, and defining therewith a second chamber; said housing end wall having an opening in alignment with and through which relatively moves said stationary arc contact; means cooperatively defined by an exterior of said bell-shaped member and an interior of said housing for forming arc-quenching gas flow zones in said second chamber for directing arc-quenching gas along said second chamber toward said opening, into said first chamber and into said tulip contact; and said arc-quenching gas flow zones include both low speed/low pressure zones and high speed/-high pressure zones.

2. The electric arc interruption chamber as defined in claim 1 wherein said low speed/low pressure and high speed/high pressure zones are in alternating relationship.

3. The electric arc interruption chamber as defined in claim 1 wherein said bell-shaped member peripheral wall is devoid of vent openings whereby arc-quenching gas flow is limited to axial flow through said second chamber.

4. The electric arc interruption chamber as defined in claim 1 wherein each of said fingers has an enlarged terminal end.

5. The electric arc interruption chamber as defined in claim 1 wherein each of said fingers has an enlarged terminal end, adjacent fingers being spaced from each other by a narrow elongated slit, and each slit having a blind end terminating in an enlarged hole.

6. The electric arc interruption chamber as defined in claim 1 wherein said arc-quenching gas flow zone forming means further directs the flow of arc-quenching gas axially along said bell-shaped member exterior and radially inwardly toward said openings.

7. The electric arc interruption chamber as defined in claim 1 wherein each of said fingers has an enlarged terminal end, said first chamber includes a chamber portion spaced remotely from said bell-shaped member end wall adjacent fingers being spaced from each other by a narrow elongated slit, and each slit has a blind end terminating in an enlarged hole opening into said chamber portion.

8. The electric arc interruption chamber as defined in claim 1 wherein said first chamber includes a chamber portion spaced remotely from said bell-shaped member end wall, a radial end wall normally closing said chamber portion, and at least one opening in said radial end wall for communicating arc-quenching gas therethrough from said chamber portion.

9. The electric arc interruption chamber as defined in claim 1 wherein said first chamber includes first and second generally annular chamber portions, said first annular chamber portion is immediately adjacent said openings and said second annular chamber portion is more remote from said openings, and said first annular chamber portion is radially narrower than said second annular chamber portion.

10. The electric arc interruption chamber as defined in claim 1 wherein said arc-quenching gas flow zone forming means are defined by a plurality of alternating ribs and grooves.

11. The electric arc interruption chamber as defined in claim 1 wherein said arc-quenching gas flow zone forming means are defined by a plurality of alternating ribs and grooves of said bell-shaped member exterior.

12. The electric arc interruption chamber as defined in claim 1 wherein said arc-quenching gas flow zone forming means are defined by a plurality of alternating ribs and grooves carried by said bell-shaped member peripheral wall and end wall.

13. The electric arc interruption chamber as defined in claim 1 wherein said arc-quenching gas flow zone forming means are defined by a plurality of alternating ribs and grooves, and said ribs and groove have radially inwardly converging portions on said bell-shaped member end wall.

14. The electric arc interruption chamber as defined in claim 10 wherein said first chamber includes first and second generally annular chamber portions, said first annular chamber portion is immediately adjacent said openings and said second annular chamber portion is more remote from said openings, and said first annular chamber portion is radially narrower than said second annular chamber portion.

15. The electric arc interruption chamber as defined in claim 10 wherein said first chamber includes a chamber portion spaced remotely from said bell-shaped member end wall, a radial end wall normally closing said chamber portion, and at least one opening in said radial end wall for communicating arc-quenching gas therethrough from said chamber portion.

16. The electric arc interruption chamber as defined in claim 10 wherein each of said fingers has an enlarged terminal end, said first chamber includes a chamber portion spaced remotely from said bell-shaped member end wall adjacent fingers being spaced from each other by a narrow elongated slit, and each slit has a blind end terminating in an enlarged hole opening into said chamber portion.

17. The electric arc interruption chamber as defined in claim 10 wherein said bell-shaped member peripheral wall is devoid of vent openings whereby arc-quenching gas flow is limited to axial flow through said second chamber.

18. The electric arc interruption chamber as defined in claim 10 wherein said arc-quenching gas flow zone forming means further directs the flow of arc-quenching gas axially along said bell-shaped member exterior and radially inwardly toward said openings.

19. The electric arc interruption chamber as defined in claim 18 wherein said first chamber includes first and second generally annular chamber portions, said first annular chamber portion is immediately adjacent said openings and said second annular chamber portion is more remote from said openings, and said first annular chamber portion is radially narrower than said second annular chamber portion.

20. The electric arc interruption chamber as defined in claim 18 wherein said first chamber includes a chamber portion spaced remotely from said bell-shaped member end wall, a radial end wall normally closing said chamber portion, and at least one opening in said radial end wall for communicating arc-quenching gas therethrough from said chamber portion.

* * * * *